US006761019B2

(12) United States Patent
Earnhart

(10) Patent No.: US 6,761,019 B2
(45) Date of Patent: Jul. 13, 2004

(54) EQUESTRIAN RIDING AID

(76) Inventor: Eileen Earnhart, 8320 Hilltop Ave., Vienna, VA (US) 22182

( * ) Notice: Subject to any disclaimer, the term of this patent is extended or adjusted under 35 U.S.C. 154(b) by 0 days.

(21) Appl. No.: 10/231,093

(22) Filed: Aug. 30, 2002

(65) Prior Publication Data

US 2003/0121237 A1 Jul. 3, 2003

Related U.S. Application Data

(60) Provisional application No. 60/315,770, filed on Aug. 30, 2001.

(51) Int. Cl.[7] ..... B68C 1/00; B68B 1/00

(52) U.S. Cl. ..... 54/23; 54/71; 54/1

(58) Field of Search ..... 54/1, 23, 44.1, 54/71; 119/770

(56) References Cited

U.S. PATENT DOCUMENTS

| | | | | |
|---|---|---|---|---|
| 232,712 A | | 9/1880 | Hastings | |
| 262,053 A | | 8/1882 | King | |
| 853,586 A | * | 5/1907 | Johnson et al. | 54/1 |
| 907,927 A | | 12/1908 | Wetzke | |
| 1,130,049 A | | 2/1915 | Welches | |
| 1,776,892 A | | 9/1930 | Domler | |
| 1,980,222 A | | 11/1934 | Ogush | |
| 2,608,812 A | * | 9/1952 | Hutchings | 54/44.1 |
| 2,933,795 A | | 4/1960 | Meeker | |
| 3,737,958 A | | 6/1973 | Sharaf | |
| 4,188,001 A | | 2/1980 | Greger | 244/151 |
| 5,029,434 A | | 7/1991 | Erickson | 54/46 |
| 5,226,282 A | | 7/1993 | Meyers | |
| 5,274,986 A | | 1/1994 | Gonzales | 54/44.1 |
| 5,284,005 A | | 2/1994 | Jacobi | 54/44.2 |
| 5,383,327 A | | 1/1995 | Dohln | 54/44.1 |
| 5,685,133 A | | 11/1997 | Travis | 54/44.7 |
| 5,802,822 A | | 9/1998 | Holzhauser | 54/46.1 |
| 5,832,573 A | | 11/1998 | Howell | 24/664 |
| 5,949,339 A | * | 9/1999 | Ettinger et al. | 54/44.1 |
| 6,105,345 A | * | 8/2000 | Dunton et al. | 54/1 |
| 6,164,048 A | * | 12/2000 | Rhodes | 54/23 |
| 6,378,278 B1 | | 4/2002 | Talbot | |

FOREIGN PATENT DOCUMENTS

| | | |
|---|---|---|
| EP | 0 860 397 A1 | 8/1998 |
| EP | 0 974 549 A1 | 1/2000 |

* cited by examiner

*Primary Examiner*—Charles T. Jordan
*Assistant Examiner*—Elizabeth Shaw
(74) *Attorney, Agent, or Firm*—Birch, Stewart, Kolasch & Birch, LLP

(57) ABSTRACT

An equestrian riding aid is disclosed which includes a girth strap which surrounds the girth of a horse, and a back strap which surrounds the back of a rider. The girth strap passes along the thighs of the rider and promotes the rider to learn and maintain the correct riding posture on the horse. The straps are connected by a quick-release buckle which allows the straps to be released from one another quickly and easily by the rider.

20 Claims, 7 Drawing Sheets

EQUESTRIAN RIDING AID

This nonprovisional application claims priority under 35 U.S.C. §119(e) on provisional Patent Application No. 60/315,770, filed in the United States on Aug. 30, 2001, which is herein incorporated by reference.

BACKGROUND OF THE INVENTION

1. Field of the Invention

The present invention relates to an equestrian riding aid for training a rider to properly sit and ride a horse with the correct riding posture.

2. Description of the Background Art

Various saddles and equestrian riding aids have been developed for restraining a rider to a saddle or to provide a therapeutic saddle. For example, U.S. Pat. No. 5,029,434 to Erickson, U.S. Pat. No. 5,802,822 to Holzhauzer, and U.S. Pat. No. 5,284,005 to Jacobi disclose straps and retaining devices for securing a rider to a saddle. U.S. Pat. No. 5,685,133 to Travis, U.S. Pat. No. 5,383,327 to Dohln, and U.S. Pat. No. 5,274,986 to Gonzales disclose therapeutic saddles for providing a more comfortable riding saddle for a rider.

Heretofore, the prior art has not addressed or provided an equestrian riding aid which trains a rider to sit properly on a horse in order to achieve the correct posture thereon.

SUMMARY OF THE INVENTION

It is therefore an object of the present invention to provide an equestrian riding aid which will train a rider to sit properly on a horse and to develop the correct posture for riding the horse.

It is a further object of the invention to provide an equestrian riding aid which will allow a rider to adjust their muscles and seat development to remember the correct and most effective position on any horse.

It is a further object of the invention to provide an equestrian riding aid including a strap which surrounds the horse and the rider to assist in retaining the rider on the horse.

It is still a further object of the invention to provide a strap which can be quickly and easily released by the rider using a quick release system.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION OF THE PREFERRED EMBODIMENTS

Figure 1:
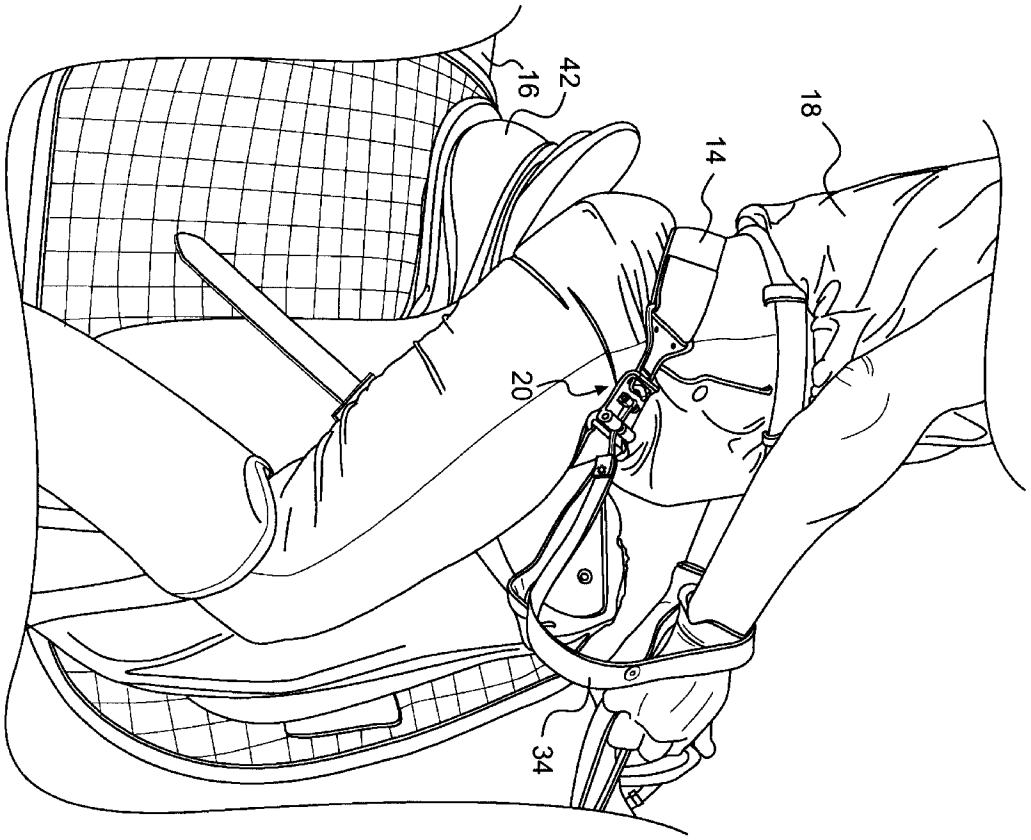
FIG. 1 is a right side view of a rider positioned on a horse utilizing the equestrian riding aid of the present invention.
Figure 2:
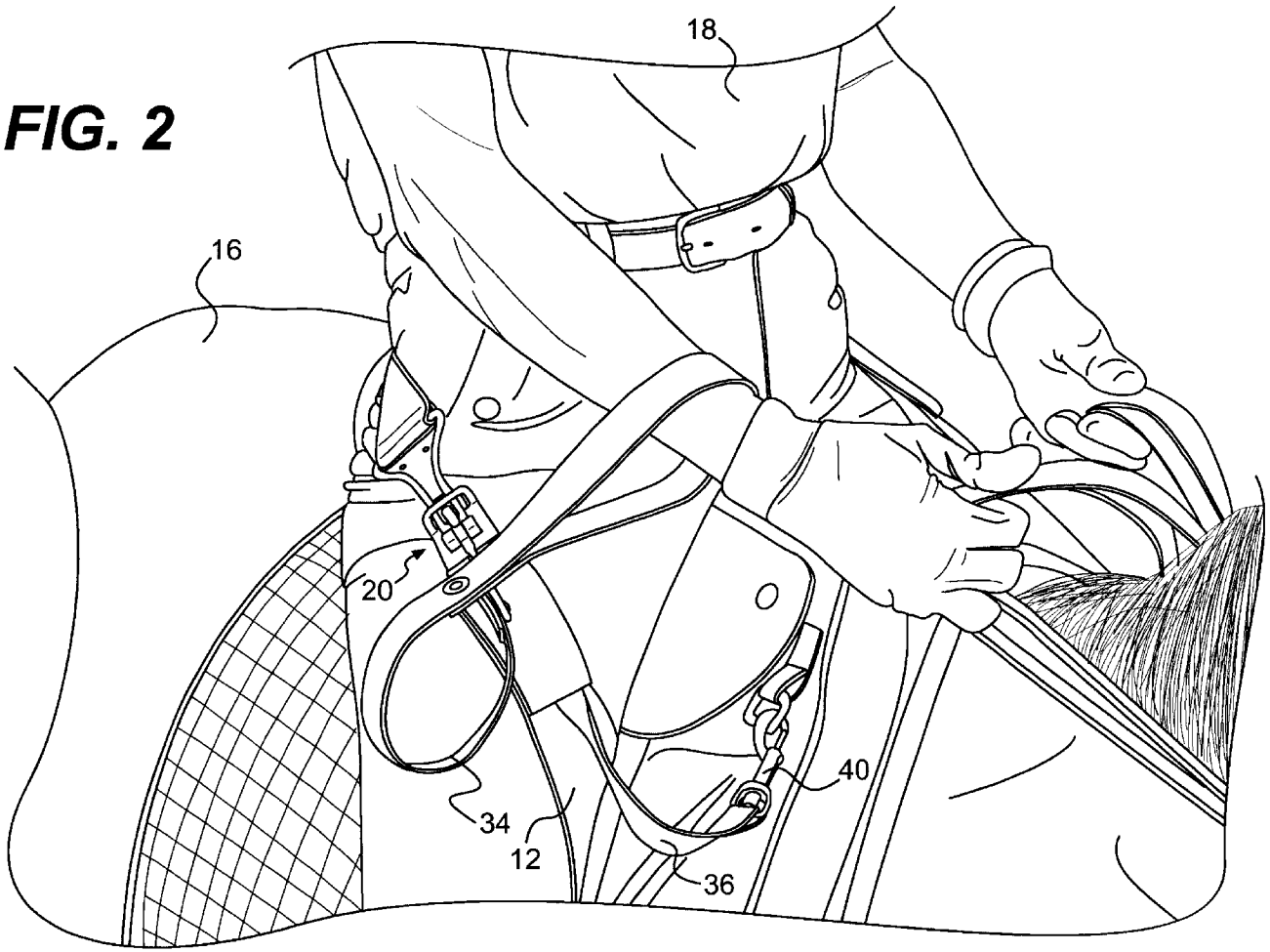
FIG. 2 is a front perspective view of the rider and the equestrian riding aid, showing the quick release system and the strap surrounding the rider's forearm.
Figure 3:
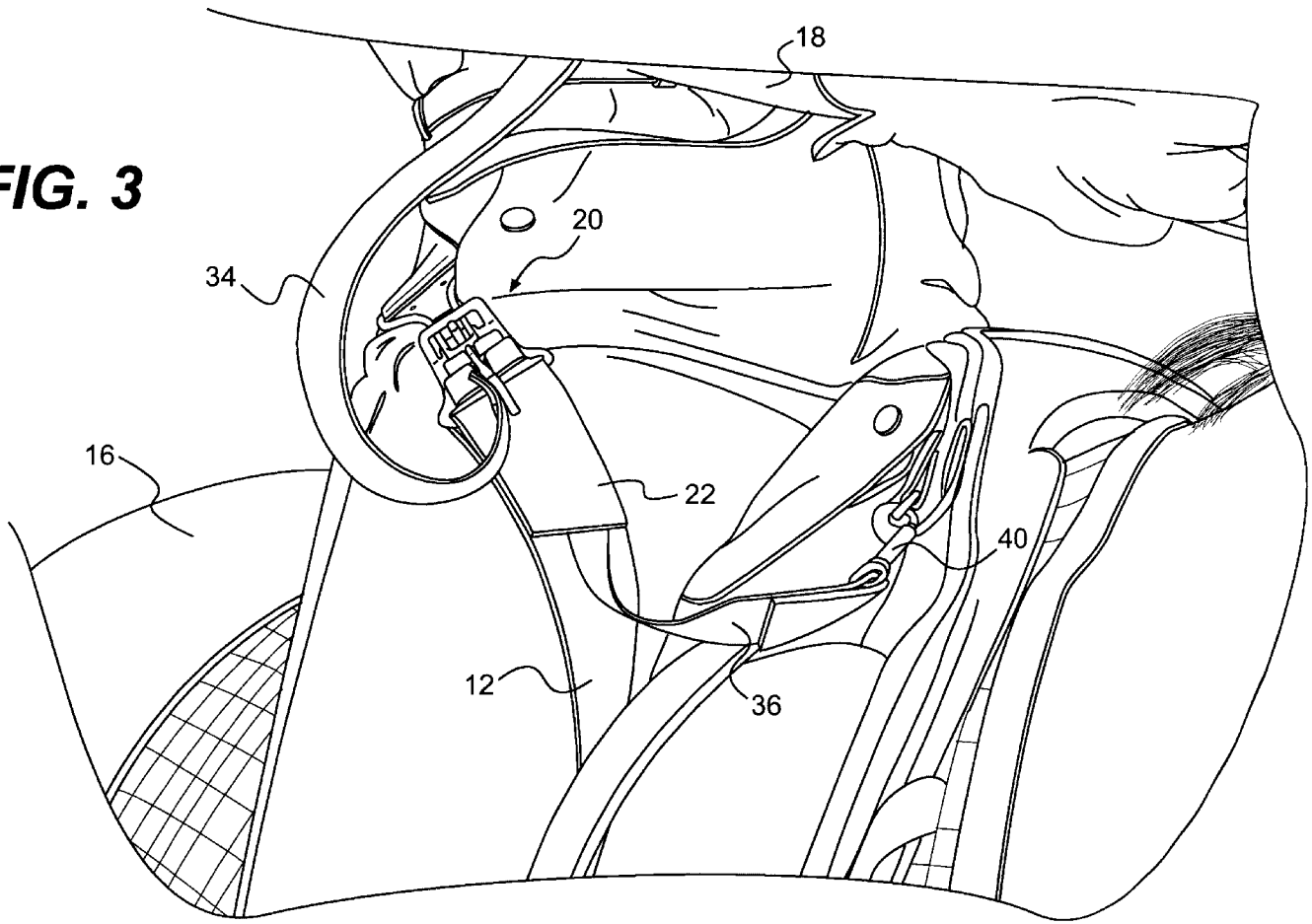
FIG. 3 is a front perspective view showing a close up of the quick release buckle in a latched position.
Figure 4:
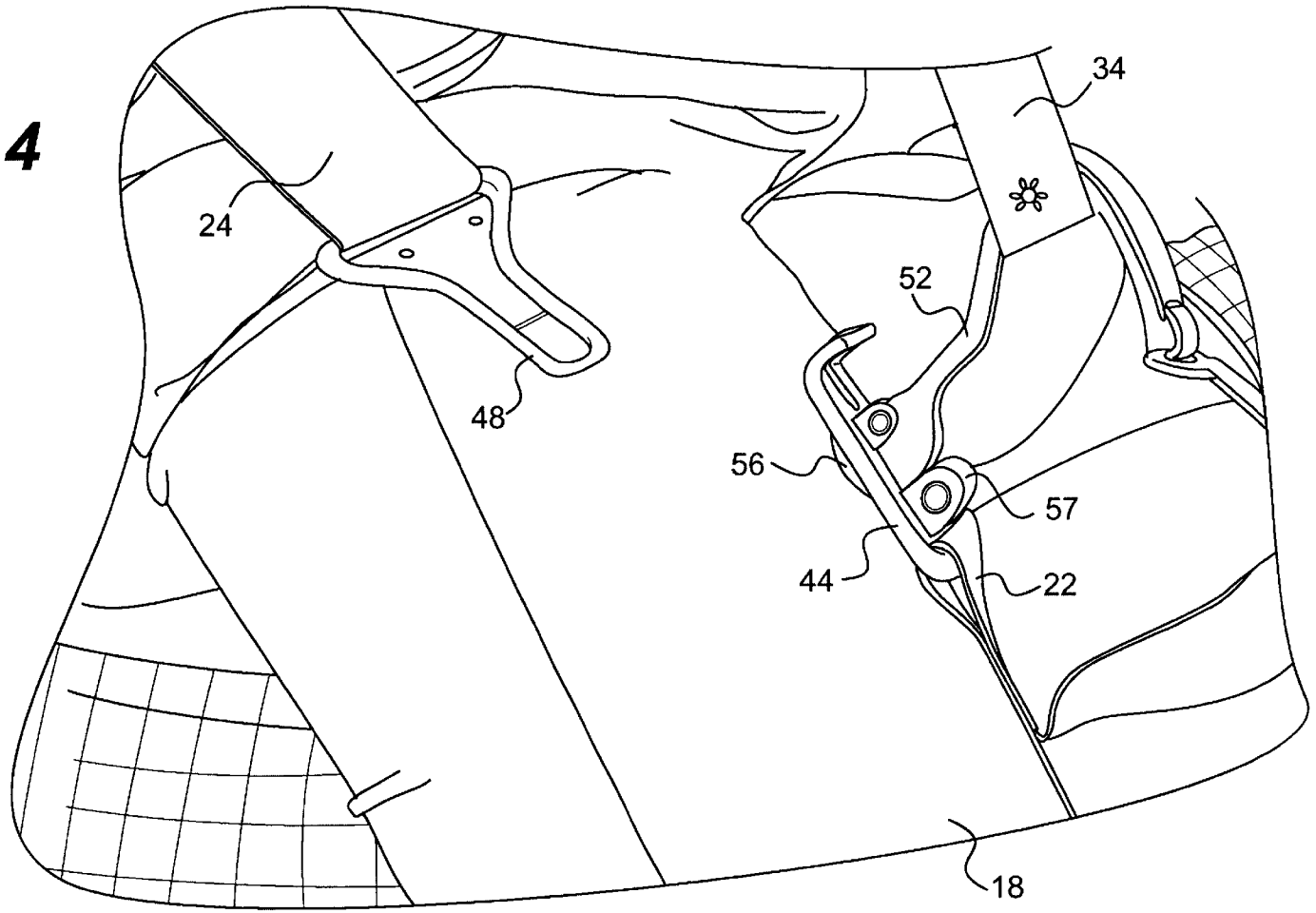
FIG. 4 is a side view of the quick release buckle in an open, released position.
Figure 5:
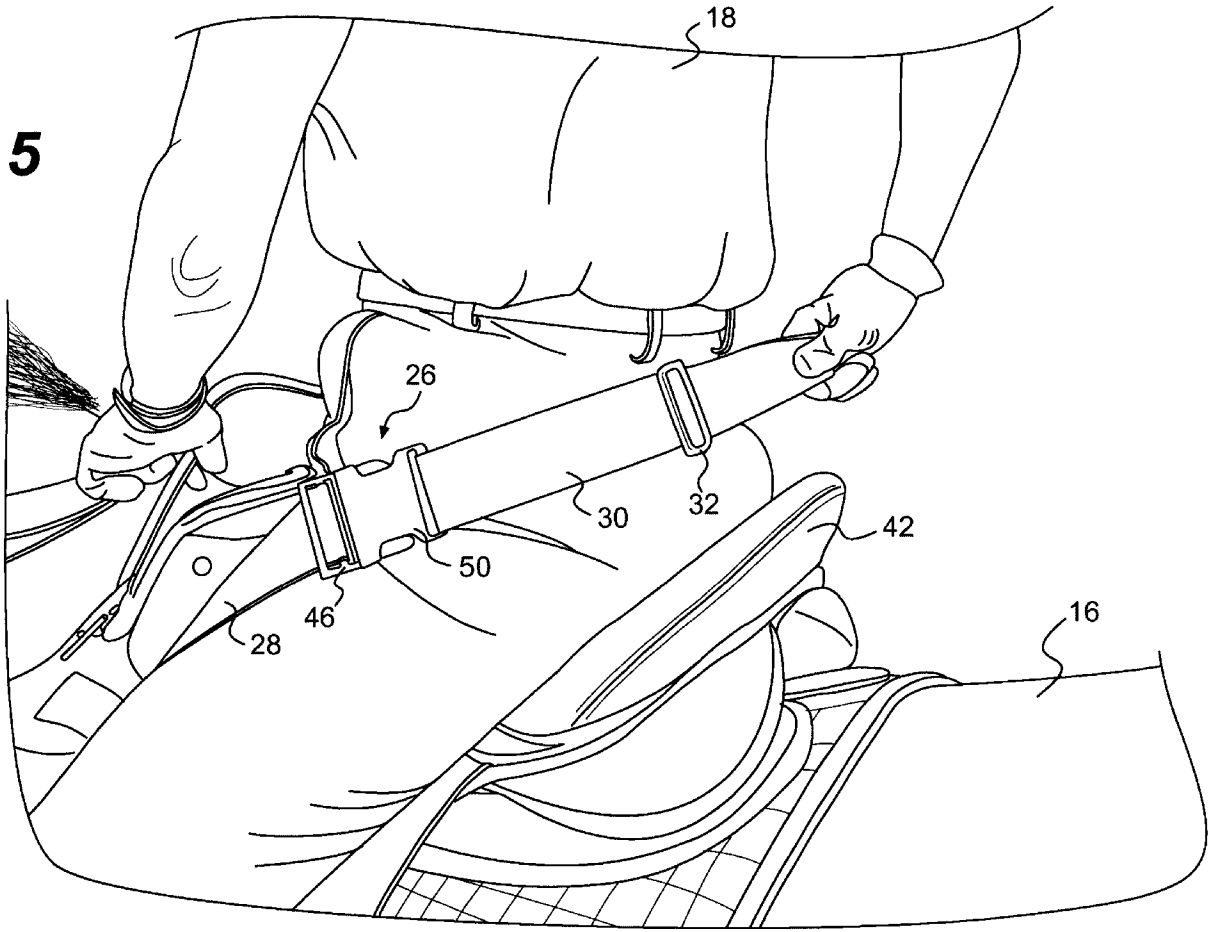
FIG. 5 is a rear perspective view showing the adjustability of the equestrian riding aid.
Figure 6:
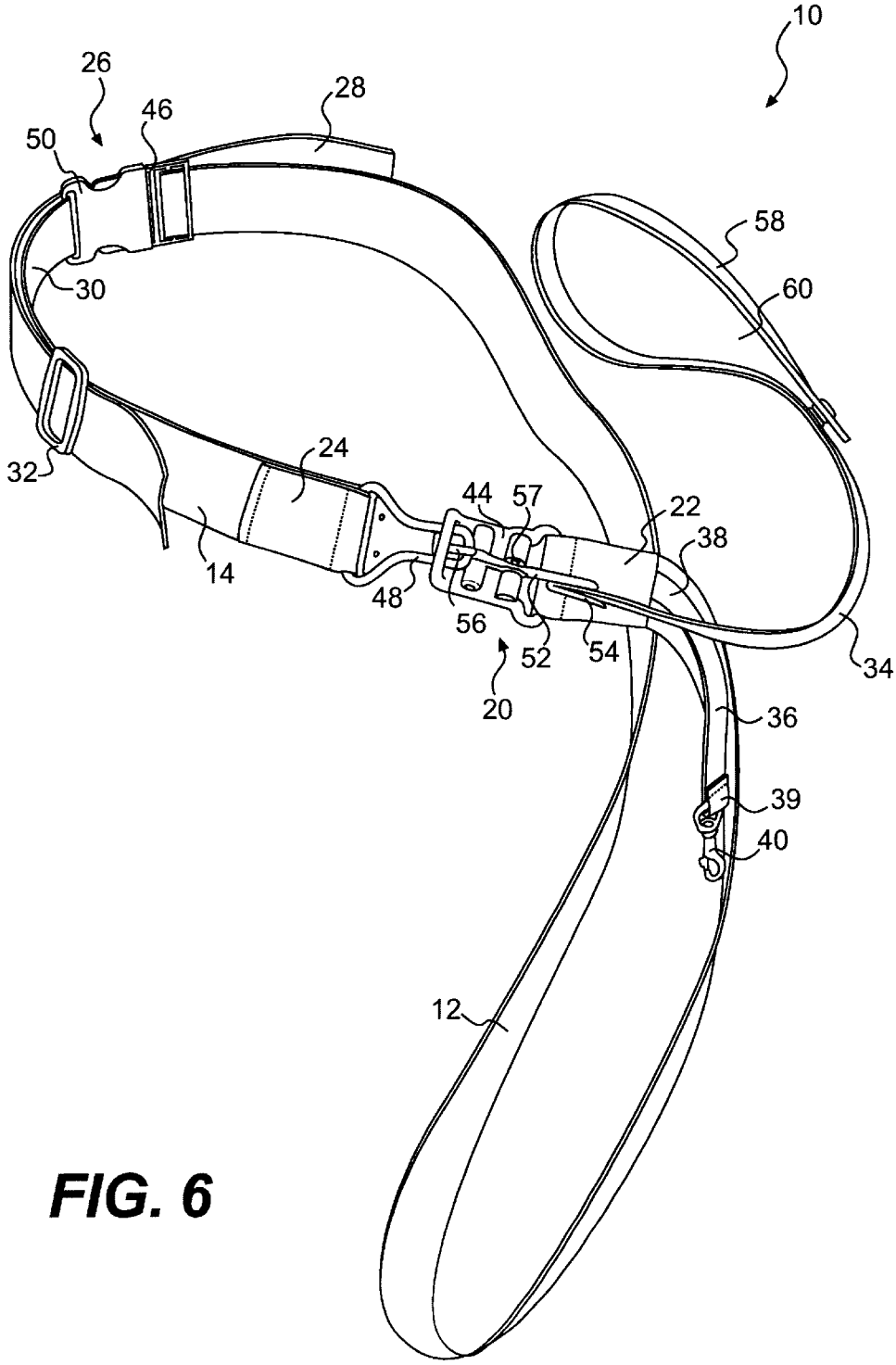
FIG. 6 is a perspective view of the equestrian riding aid.
Figure 7:
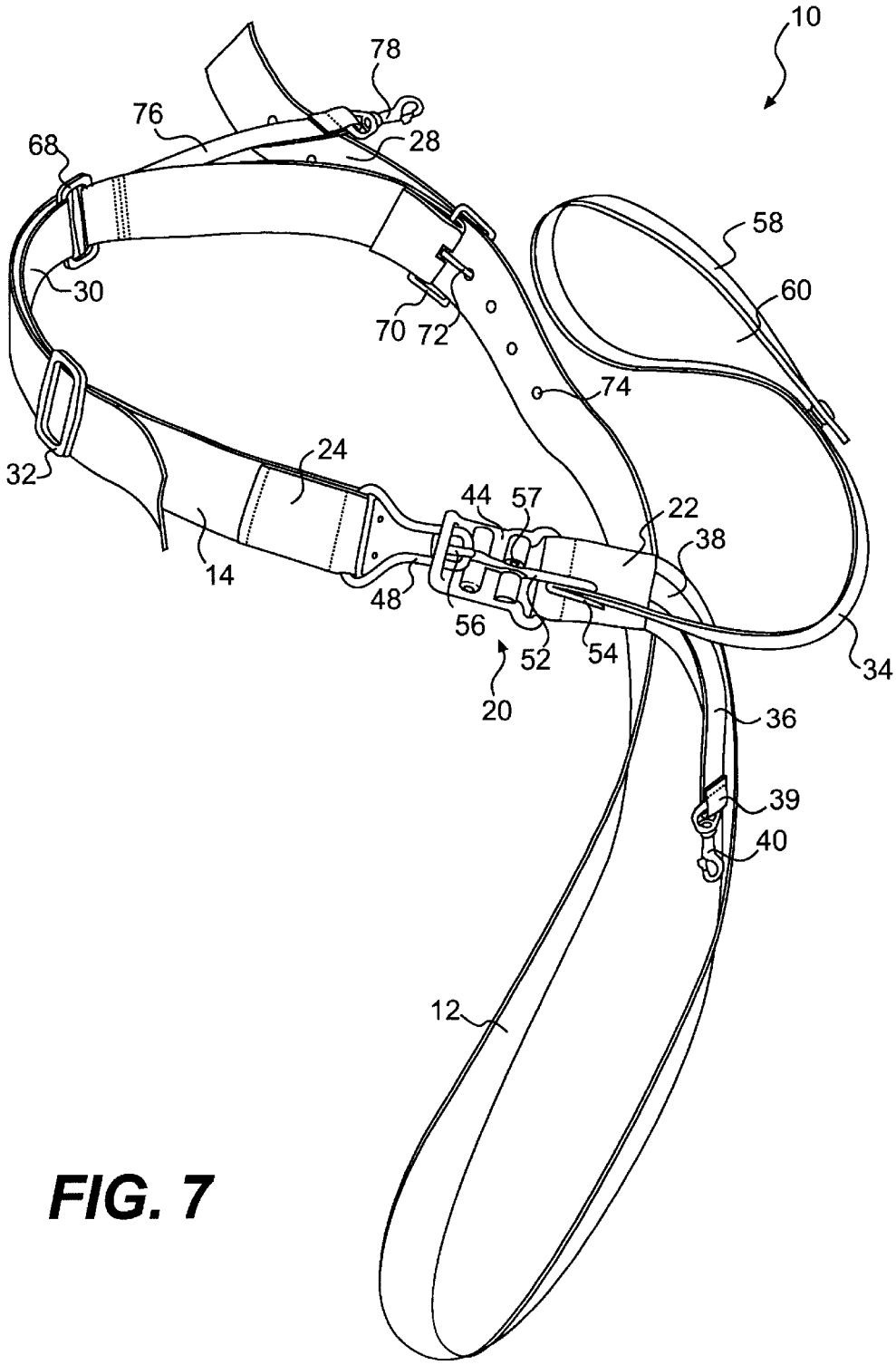
FIG. 7 is a perspective, view of an alternative embodiment of the equestrian riding aid.

Referring now to FIGS. 1-7, and in particular FIGS. 6 and 7, the equestrian riding aid 10 of the present invention includes a girth strap 12 connected with a back strap 14 which together form a continuous loop which encircles the girth of a horse 16 and the lower back of a rider 18. The girth strap 12 and back strap. 14 may be made of various materials, such as nylon, leather, seat belt material or other webbing or strapping material. The length of the girth strap 12 is longer than the back strap 14, since it is designed to traverse a longer distance around the girth of the horse 16.

A quick-release buckle 20 interconnects a first end 22 of the girth strap 12 with a first end 24 of the back strap 14. An attachment buckle 26 interconnects a second end portion 28 of the girth strap 12 with a second end portion 30 of the back strap 14. An adjustment clip 32 is located along the back strap 14 for adjusting the length of the back strap 14.

A release strap 34 is attached to the quick-release buckle 20 which, when pulled, releases the interconnection of the quick-release buckle 20, thereby disconnecting the girth strap 12 from the back strap 14.

A saddle strap 36 has a first end 38 secured to the first end 22 of the girth strap 12, and includes a saddle clip 40 located at a second end 39 thereof. The saddle clip 40 is attachable to a D-ring on a saddle 42 to thereby secure the entire equestrian riding aid 10 to the saddle 42.

The first end 22 of the girth strap 12 is looped around a latch member 44 of the quick-release buckle 20, and folded back onto itself and secured, such as by stitching, riveting, or heat-bonding. Also, the first end 38 of the saddle strap 36 is secured together with the first end 22 of the girth strap 12. The second end portion 28 of the girth strap 12 loops through a prong member 46 of the attachment buckle 26 and passes back therethrough. This leaves the second end portion 28 of the girth strap 12 free so that it may be pulled on to adjust the length of the girth strap 12.

The first end 24 of the back strap 14 is looped around a ring member 48 of the quick-release buckle 20, and folded back onto itself and secured, such as by stitching, riveting, or heat-bonding. The back strap 14 passes through two slotted apertures in the adjustment clip 32, then passes through a prong-receiving member 50 of the attachment buckle 26, and then proceeds back in the other direction through the two slotted apertures in the adjustment clip 32. This leaves the second end portion 30 of the back strap 14 free so that it may be pulled on to adjust the length of the back strap 14.

The latch member 44 of the quick-release buckle 20 includes a release lever 52 pivotally attached thereto. One end of the release lever 52 is attached to a first end 54 of the release strap 34. A second end of the release lever 52 is formed with a hook 56 which engages with the ring member 48 of the quick-release buckle 20 to secure the latch member 44 to the ring member 48 under normal conditions. A spring-biased-ball locking mechanism 57 is provided which keeps the release lever 52 against the latch member 44 under normal conditions, to keep the hook 56 engaged with the ring member 48. However, by pulling the release strap 34, the release lever 52 become disengaged from the locking mechanism 57 and is pivoted on the latch member 44, thereby dislocating the hook 56 from within the ring member 48 and disconnecting the latch member 44 from the ring member 48.

The release strap 34 has a second end 58 which is looped back onto itself and secured, such as by stitching, riveting, or heatbonding, to form a wrist loop 60 which may be placed around the wrist of the rider 18. Because the release strap 34 is wrapped around the wrist, in any situation where the rider's hands go up, the girth strap 12 and back strap 14 are released, allowing the rider 18 to immediately exit from the horse 16. Consequently, the rider 18 does not feel strapped in, restricted, or stuck on the horse 16. One pull of the release strap 34 attached to the quick-release buckle 20 and the rider 18 is free. The release strap 34 and the saddle strap 36 are generally not a wide as the girth strap 12 and the back strap 14.

Another added feature is that the girth strap 12 and back strap 14, once released, will stay on the horse 16 due to the saddle strap 36 being connected to the saddle 42. Accordingly, the equestrian riding aid 10 will not fall down around the horse's legs, thereby preventing the horse 16 from becoming afraid or spooked.

An alternative arrangement to the attachment buckle 26 is shown in FIG. 7. An extension strap 66 is provided between the second end portion 30 of the back strap 14 and the second end portion 28 of the girth strap 12. One end of the extension strap 66 is attached to a connecting clip 68, which is in turn also connected to the second end portion 30 of the back strap 14. The other end of the extension strap 66 is attached to a belt-type buckle 70 having a buckle pin 72. The buckle pin 72 is locatable in any one of a plurality of holes 74 in the second end portion 28 of the girth strap 12 to adjust the girth strap 12 on the horse 16. A second saddle strap 76 with a saddle clip 78 thereon may also be provided on the intermediate strap 66.

In use, the back strap 14 travels around the rider's back, and the girth strap 12 travels down the inside of the rider's thighs and around the horse's girth. This pulls the rider 18 deep into the saddle 42 while pulling the horse's back up simultaneously, causing the horse 16 to move correctly and a rider 18 to fit correctly and open. Through muscle memory, training and balance, the rider 18 will achieve a better seat and ride the horse 16 correctly with open hips, steady legs under the rider's body, a relaxed and supple back, an open upper body, shoulders back with elbows and hands and head in the correct relaxed position and in balance. The equestrian riding aid 10 allows the rider 18 to sit in harmony with the horse 16, and it teaches the rider 18 to swing with the horse's back without tension, therefore allowing the horse 16 to relax his back and carry the rider 18 correctly.

The equestrian riding aid 10 provides a simple, fast, and effective way to learn to sit, trot and cantor. It gives the rider 18 the security and freedom to use their legs with no pinching or gripping. The equestrian riding aid 10 allows the rider 18 to sit in unison with the horse 16, with no bouncing and wiggling. This will allow greater and more effective communication with the horse 16, and the horse 16 will feel more comfortable performing for the rider 18.

In the correct riding position, the rider's seat should swing with a very flexible hip that takes the movement and then gives it back to the horse 16. If the hip is correct in its position and movement, everything else will come into the correct place. The seat also must be elastic so that the rider 18 can influence the horse 16 correctly, in the manner of a swinging pendulum, without constantly having to drive with the legs.

The equestrian aid of the present invention may include additional items which may be attached to one or more of the straps, for example, back cushions and attachments or pockets for cell phones or water bottles, etc. may be provides on the back strap 14.

Although the present invention has been described with the use of the quick-release buckle 20 and the additional attachment buckle 26, either one of these buckles 20, 26 may be eliminated while still providing an equestrian riding aid 10 which teaches the correct posture for the rider 18. For example, the attachment buckle 26 may be eliminated, and a single strap may be used which extends around the girth of the horse 16 and the hips of the rider 18. In the preferred embodiment, the quick-release buckle 20 is made of steel, and the attachment buckle 26 is made of plastic, although various other metals and materials may be used.

Also, the connections between the straps 12, 14 and the buckles 20, 26 may be reversed. For example, the first end 22 of the girth strap 12 may be looped around the ring member 48 of the quick-release buckle 20, and the first end 24 of the back strap 14 may be looped around the latch member 44 of the quick-release buckle 20. Similarly, the second end portion 28 of the girth strap 12 may loop through the prong-receiving member 50 of the attachment buckle 26, and the back strap 14 may pass through the prong member 46 of the attachment buckle 26.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An equestrian riding aid comprising:

a strap for surrounding the girth of a horse and the back of a rider on the horse;

a quick-release buckle interconnecting opposite ends of said strap, said quick-release buckle including a release mechanism; and a release strap attached to said release mechanism of the quick-release buckle for releasing the ends of the strap from interconnection with one another.

2. The equestrian riding aid according to claim 1, wherein said strap comprises:

a girth strap having a first end and a second end portion; and a back strap having a first end and a second end portion.

3. The equestrian riding aid according to claim 2, wherein said quick-release buckle comprises:

a latch member attached to said first end of said girth strap; and a ring member attached to said first end of said back strap.

4. The equestrian riding aid according to claim 3, wherein said release mechanism includes a release lever pivotally attached thereto.

5. The equestrian riding aid according to claim 4, wherein said release lever includes a hook which engages said ring member to secure said latch member to said ring member.

6. The equestrian riding aid according to claim 4, wherein said release strap has a first end secured to said release lever, and a second end formed into a wrist loop.

7. The equestrian riding aid according to claim 2, further comprising an attachment buckle for securing said second end portion of said girth strap to said second end portion of said back member.

8. The equestrian riding aid according to claim 7, wherein said attachment buckle comprises:

a prong member attached to said second end portion of said girth strap; and a prong-receiving member attached to said second end portion of said back member, said prong member being received in said prong-receiving member to secure said prong member to said prong-receiving member.

9. The equestrian riding aid according to claim 2, further comprising an adjustment clip having a pair of slotted apertures therein, said back strap passing through said slotted apertures.

10. The equestrian riding aid according to claim 2, further comprising a saddle strap having a first end secured to said first end of said girth strap, and a second end.

11. The equestrian riding aid according to claim 10, further comprising a saddle clip secured to said second end of said saddle strap.

12. The equestrian riding aid according to claim 1, wherein said quick-release buckle comprises:

a latch member attached to a first end of said strap; and a ring member attached to a second end of said strap.

13. The equestrian riding aid according to claim 12, wherein said release mechanism includes a release lever pivotally attached thereto, said release lever including a hook which engages said ring member to secure said latch member to said ring member.

14. The equestrian riding aid according to claim 13, wherein said release strap has a first end secured to said release lever, and a second end formed into a wrist loop.

15. An equestrian riding aid comprising:

a first strap member having a first end and a second end portion;

a second strap member having a first end and a second end portion;

a first connector including a first portion attached to said first end of said first strap member, and a second portion attached to said first end of said second strap member, one of said first portion and said second portion including a release member pivotally attached thereto, said release member including a catch member which engages said second portion to secure said first portion of said first connector to said second portion of said first connector; and a second connector including a first portion attached to said second end portion of said first strap member, and a second portion attached to said second end portion of said second strap member, said first portion of said second connector being releasably securable to said second portion of said second connector.

16. The equestrian riding aid according to claim 15, further comprising a third strap member having a first end secured to said release lever, and a second end formed into a wrist loop.

17. The equestrian riding aid according to claim 16, further comprising:

a forth strap member having a first end secured to said first end of said first strap member, and a second end; and a clip member secured to said second end of said forth strap member.

18. The equestrian riding aid according to claim 17, further comprising an adjustment device having a pair of slotted apertures therein, said second strap member passing through said slotted apertures.

19. An equestrian riding aid comprising:

a girth strap having a first end and a second end portion;

a back strap having a first end and a second end portion;

a quick-release buckle including a latch member attached to said first end of said girth strap, and a ring member attached to said first end of said back strap, said latch member including a release lever pivotally attached thereto, said release lever including a hook which engages said ring member to secure said latch member to said ring member;

an attachment buckle including a prong member attached to said second end portion of said girth strap, and a prong-receiving member attached to said second end portion of said back strap, said prong member being received in said prong-receiving member to secure said prong member to said prong-receiving member;

an adjustment clip having a pair of slotted apertures therein, said back strap passing through each of said slotted apertures;

a release strap having a first end secured to said release lever, and a second end formed into a wrist loop;

a saddle strap having a first end secured to said first end of said girth strap, and a second end; and a saddle clip secured to said second end of said saddle strap.

20. An equestrian riding aid comprising:

a girth strap having a first end and a second end portion, said second end portion having a plurality of spaced-apart holes therein;

a back strap having a first end and a second end portion;

an extension strap having a first end and a second end;

a quick-release buckle including a latch member attached to said first end of said girth strap, and a ring member attached to said first end of said back strap, said latch member including a release lever pivotally attached thereto, said release lever including a hook which engages said ring member to secure said latch member to said ring member;

a belt buckle including a buckle pin attached to said first end of said extension strap, said buckle pin being received in one of said plurality of holes in said second end portion of said girth strap;

a connecting clip having an aperture therein, said second end of said extension strap being secured to said connecting clip, said back strap passing through said aperture;

an adjustment clip having a pair of slotted apertures therein, said back strap passing through each of said slotted apertures;

a release strap having a first end secured to said release lever, and a second end formed into a wrist loop;

a saddle strap having a first end secured to said first end of said girth strap, and a second end; and a saddle clip secured to said second end of said saddle strap.

* * * * *